US006510639B2

(12) United States Patent
McMoore

(10) Patent No.: US 6,510,639 B2
(45) Date of Patent: Jan. 28, 2003

(54) FIREARM SAFETY LOCK

(76) Inventor: William A. McMoore, 4203 Fairway Cir., Port Orchard, WA (US) 98367

( * ) Notice: Subject to any disclaimer, the term of this patent is extended or adjusted under 35 U.S.C. 154(b) by 0 days.

(21) Appl. No.: 09/747,984

(22) Filed: Jan. 5, 2001

(65) Prior Publication Data

US 2002/0088159 A1 Jul. 11, 2002

(51) Int. Cl.[7] ..... F41A 17/02; F41A 17/22
(52) U.S. Cl. ..... 42/70.06; 42/70.08; 42/70.11
(58) Field of Search ..... 42/66, 70.01, 7, 42/70.11; 89/4.05, 137

(56) References Cited

U.S. PATENT DOCUMENTS

| | | | | | |
|---|---|---|---|---|---|
| 3,673,725 | A | * | 7/1972 | Cravener | 42/1 |
| 3,882,622 | A | * | 5/1975 | Perlotto | 42/1 |
| 4,136,475 | A | * | 1/1979 | Centille | 42/1 |
| 4,261,127 | A | * | 4/1981 | Karkkainen | 42/1 |
| 4,457,091 | A | * | 7/1984 | Wallerstein | 42/1 |
| 4,967,502 | A | * | 11/1990 | Vernon | 42/70.08 |
| 5,229,532 | A | | 7/1993 | Brooks | |
| 5,335,521 | A | | 8/1994 | Brooks | |
| 5,361,525 | A | * | 11/1994 | Bowes | 42/70.11 |
| 5,408,777 | A | | 4/1995 | Brooks | |
| 5,581,927 | A | * | 12/1996 | Meller | 42/70.11 |
| 5,666,754 | A | | 9/1997 | de Oliveira Masina | |
| 5,671,560 | A | | 9/1997 | Meller | |
| 5,749,166 | A | | 5/1998 | Brooks | |
| 5,910,003 | A | | 6/1999 | Kleinpaul | |
| 5,974,717 | A | | 11/1999 | Brooks | |
| 5,987,796 | A | | 11/1999 | Brooks | |

OTHER PUBLICATIONS

Heckler & Koch, Inc.; Heckler & Koch's "Lock–Out" New Feature in USP and USP Compact Pistols; press release; Oct. 1, 1999; USA.

The Complete Book of Autopistols 2001; Harris Outdoor Group; pp. 16–21 and 52–58.

* cited by examiner

*Primary Examiner*—Charles T. Jordan
*Assistant Examiner*—Bret Hayes
(74) *Attorney, Agent, or Firm*—Greenebaum, Doll & McDonald; Glenn D. Bellamy

(57) ABSTRACT

Shown is a locking, grip-enclosed safety device for a firearm. The grip-enclosed mechanism has an externally-operable locking selector which is operable by a user to be locked into distinct armed and unarmed positions. The locking selector actuates a mechanical trigger/firing mechanism interruption member between distinct armed and unarmed positions.

11 Claims, 7 Drawing Sheets

FIREARM SAFETY LOCK

TECHNICAL FIELD

This invention relates to a safety locking device for firearms, especially semi-automatic pistols. The invention provides a lock enclosed within the grip which is externally operable and provides a mechanical interruption to the firing/trigger mechanism when locked in a disarmed condition.

BACKGROUND

It is well recognized by responsible gun owners that safeguards must be taken to prevent access to or use of their firearms by any unauthorized persons, whether child or adult. It is neither acceptable nor adequate to simply hide a firearm in the hope that a child, a burglar, or an irresponsible adult will never find and misuse it.

Externally-applied trigger locks are not an acceptable solution because, in some cases, the gun may still be fired when the trigger lock is in place, on a loaded gun. Other externally-applied safety devices, such as locking magazine substitutes or barrel locks are commonly available. These devices, which may be effective to prevent unauthorized use of a firearm, are unacceptable for other reasons. Because such locking devices are separable from the firearm, they must be carried separately, such as when traveling, and may be awkward and not immediately available when needed.

Prior art locking devices built into the firearm typically add significant bulk to the gun and significantly change its profile or contour. These devices have been unacceptable, especially to those who legally carry the firearm concealed. What has been needed is a locking device which is incorporated into the firearm itself which is fully functional to prevent unauthorized use whether the gun is loaded or unloaded, does not add bulk or alter the gun's profile, and which uses a pick-resistant locking selector, rather than one which may be defeated by a common ordinary tool.

SUMMARY OF THE INVENTION

The present invention provides a safety device for a firearm which is lockable between distinct armed and unarmed positions and which is enclosed within the grip of the firearm. The grip-enclosed mechanism has an externally-operable locking selector and a mechanical trigger/firing mechanism interruption member. The locking selector is operable by a user to be locked in the distinct armed and unarmed positions and the locking selector actuates the interruption member between respective distinct armed and unarmed positions.

In preferred form, the locking selector is actuated by a key which is separable from the device. Alternatively, the locking selector may be operated electrically or by any other suitable means. Preferably, the device of the present invention is incorporated into the grip of a firearm rearward of an ammunition magazine passageway in space within the grip which would otherwise be unused. The present invention may be used on a firearm with or without a grip safety. However, the preferred form of the invention is to include a grip safety and for the interruption member to include a rotatable piece having a portion within the grip which interacts with the grip safety to block actuation of the grip safety in one position and to allow actuation of the grip safety in the other position. The interacting parts may be a blade and a slot, one on the interruption member and one on an internal portion of the grip safety, such that in the armed position, the blade fits into the slot to allow actuation of the grip safety and in the unarmed position, the blade will not fit into the slot, thereby preventing operation of the grip safety. In preferred form, an ammunition magazine lock member is mounted on and rotates with the rotating interruption member.

Alternatively, the locking selector may actuate axially to cause either axial or rotational actuation of the interruption member.

Other features and attributes of the present invention will become apparent upon examination of the various figures of the drawing, the description of the inventor's preferred mode for carrying out the invention, and the claims, all of which collectively comprise the disclosure of the present invention.

BRIEF DESCRIPTION OF THE DRAWING

Like reference numerals are used to indicate like parts throughout the various figures of the drawing, wherein.

BEST MODE FOR CARRYING OUT THE INVENTION

Figure 1:
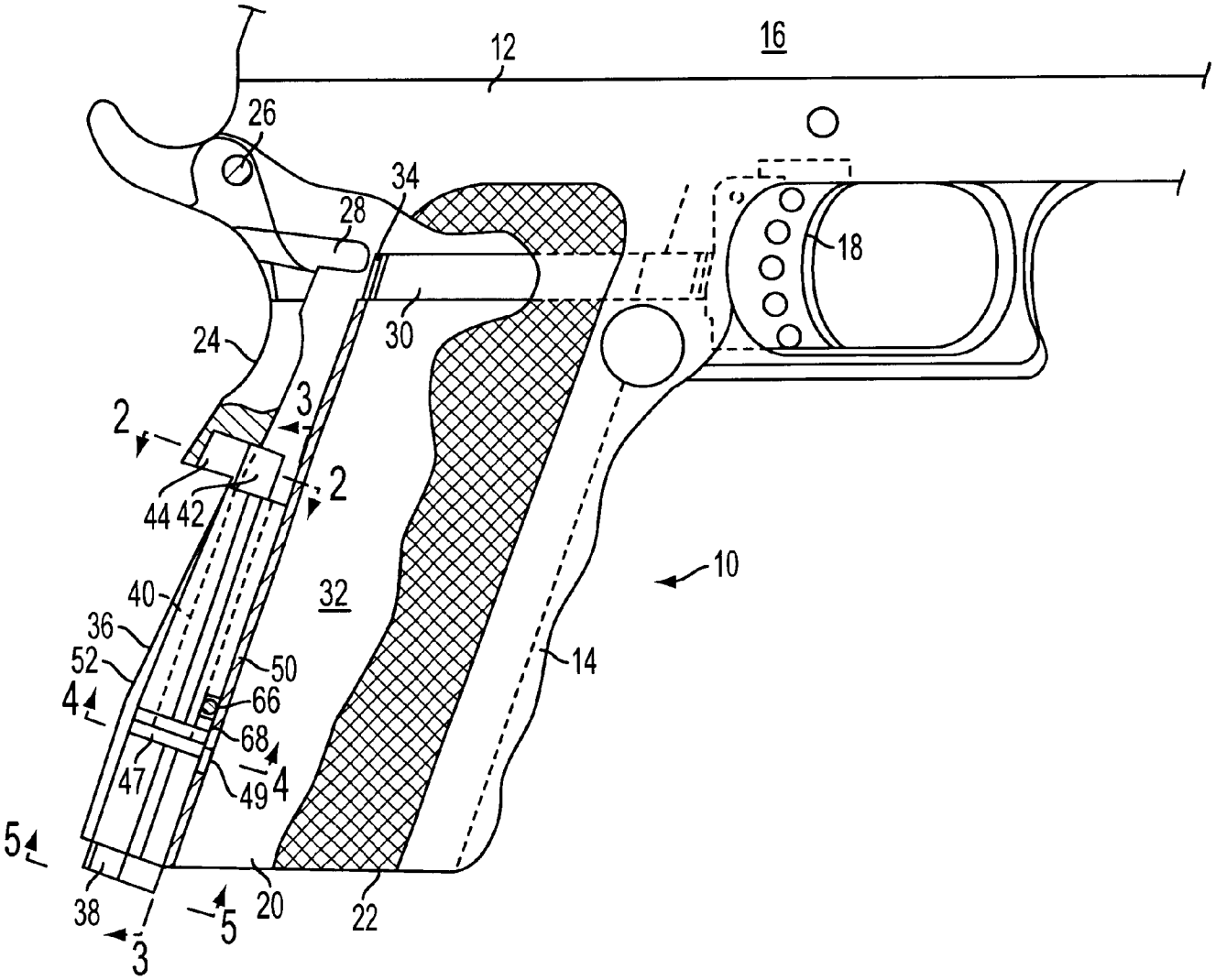
FIG. 1 is a partially cut-away, fragmentary view of the grip and trigger portion of a semi-automatic pistol which includes a preferred embodiment of the present invention.

Referring to the several figures of the drawing, and first to FIG. 1, therein is shown at 10 a semi-automatic pistol having a receiver 12, a grip 14, a slide 16 and a trigger 18. The firearm 10 shown is of the well-known type in which a magazine (not shown) is inserted into a magazine opening 20 in the butt end 22 of the grip 14. The illustrated embodiment is similar to the well-known Colt Government Model 1911 which has a palm grip safety 24 and a linear action trigger 18.

Figure 6:
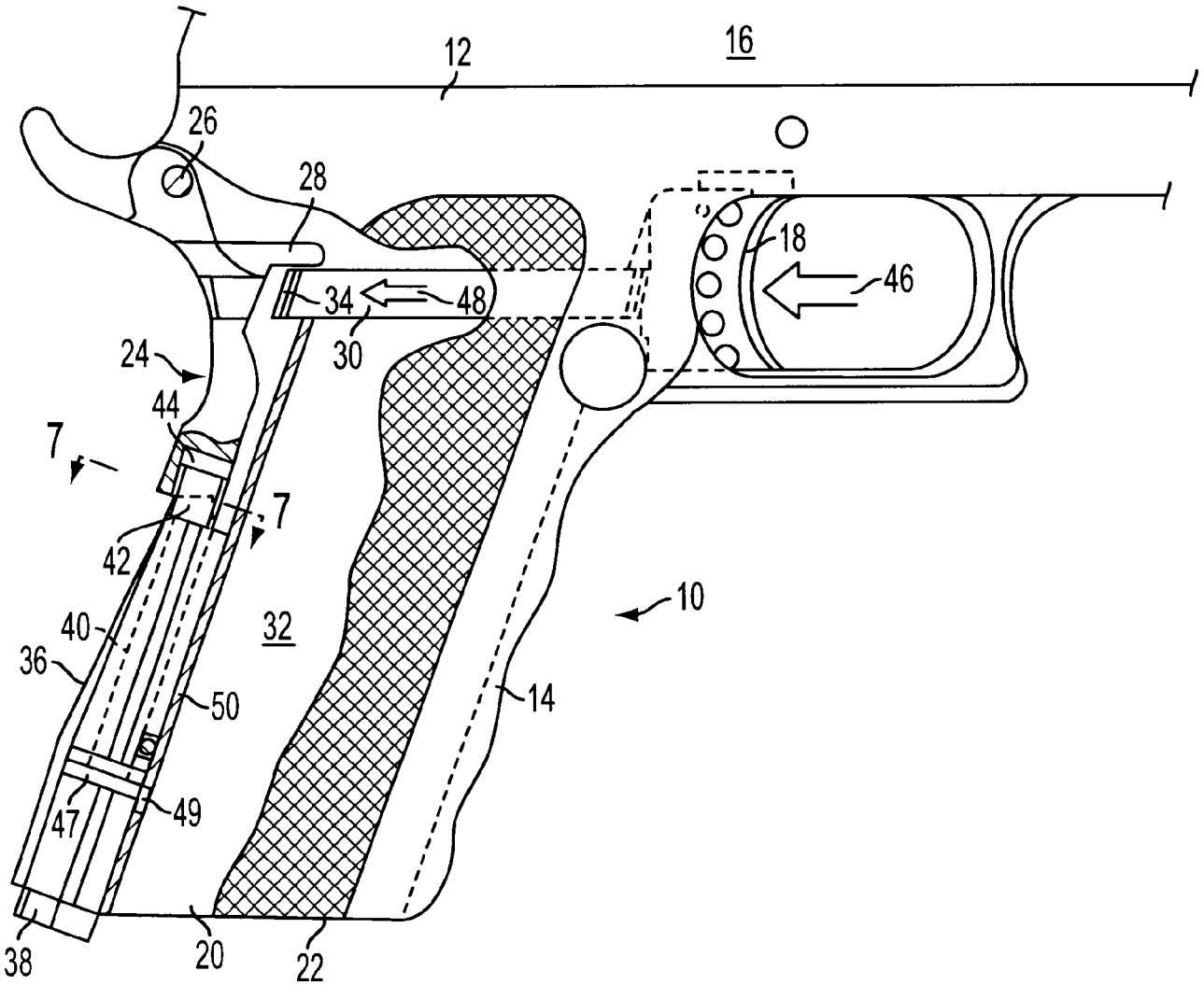
FIG. 6 is a partially cut-away fragmentary view similar to FIG. 1 showing the palm grip and trigger depressed in a firing condition.
Figure 8:
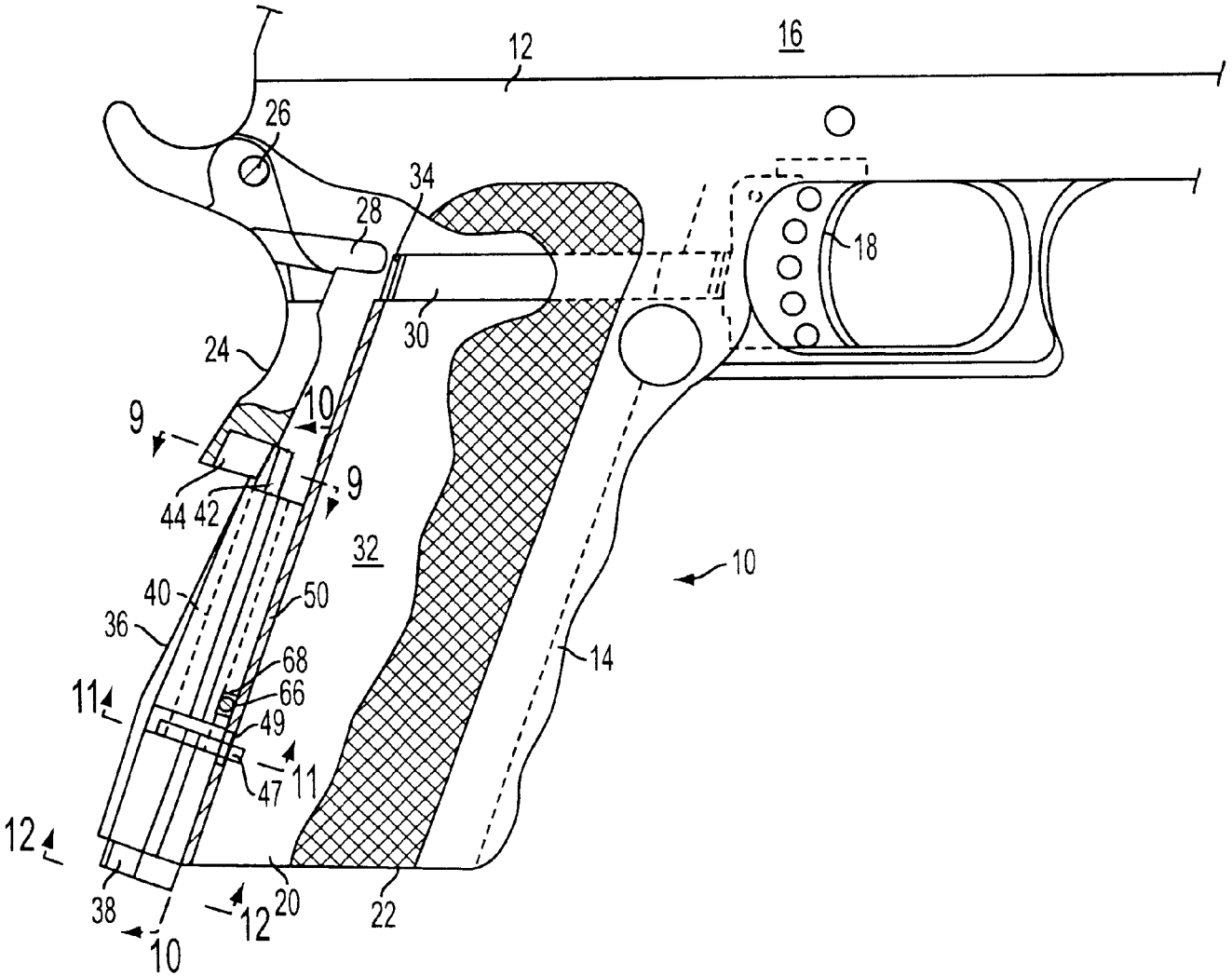
FIG. 8 is a partially cut-away, fragmentary view similar to FIGS. 1 and 6 showing the safety lock in a disarmed condition.
Figure 10:
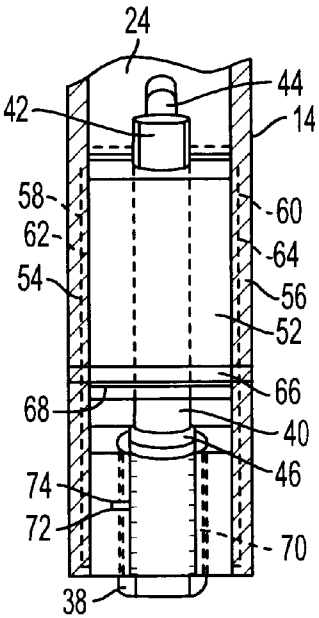
FIG. 10 is a longitudinal sectional view taken substantially along line 10—10 of FIG. 8 and similar to FIG. 3 showing the lock in a disarmed condition.
Figure 9:
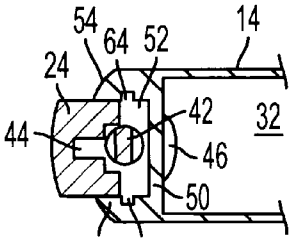
FIG. 9 is a sectional view taken substantially along line 9—9 of FIG. 8 showing the palm grip safety block.
Figure 11:
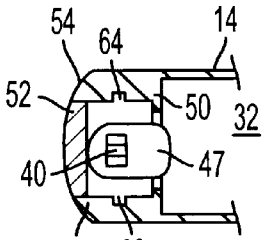
FIG. 11 is a sectional view taken substantially along line 11—11 of FIG. 8 and similar to FIG. 4 showing the magazine lock in a disarmed condition.
Figure 12:
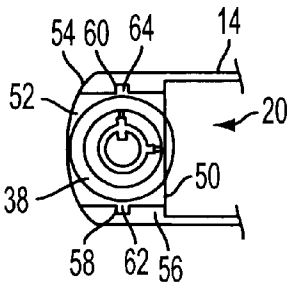
FIG. 12 is an end view taken substantially along line 12—12 of FIG. 8 showing the lock in a disarmed condition.

As is well-known in the art, the grip safety 24 or "beaver tail" is pivotally mounted at the rear end of the receiver on a pivot pin 26. The grip safety 24 is spring biased (not shown) into the position shown in FIG. 1. The grip safety 24 includes a forwardly-extending projection 28 which blocks rearward movement of the trigger 18. Typical of the popular Model 1911, the trigger assembly includes the linear sliding trigger 18 and a rearwardly-extending bail 30 which substantially surrounds the magazine passageway 32. The trigger bail 30 includes rearwardly-extending side members connected at rearward ends by a transverse end 34. It is this transverse end 34 which abuts with the projection 28 of the grip safety 24, thereby preventing actuation of the trigger assembly unless and until the grip safety 24 is depressed and the projection 28 is moved out of the pathway of the trigger bail 30, as shown, for example, in FIG. 6.

The present invention provides a locking mechanism 36 which prevents firing of the pistol 10 by mechanically blocking the firing/trigger mechanism. In the embodiment illustrated in FIGS. 1–12, the mechanical interruption to the firing/trigger mechanism is accomplished by blocking the grip safety 24 from being depressed by means of a member that may be positively locked in an "armed" or "disarmed" condition. Of course, by preventing the grip safety 24 from being depressed, it is impossible to depress the trigger mechanism 18, 30, 34 to actuate the firing mechanism (not shown) of the pistol 10.

Referring now also to FIGS. 2–5, it can be seen that the preferred embodiment of the lock mechanism 36, includes a keyed lock cylinder 38 which is exposed at the butt end 22 or heal of the grip 14 rearward of the magazine entry 20 and magazine passageway 32. The cylinder lock 38 is operatively connected to an elongated rotatable rod 40 on which is formed or attached a flat blade 42 at its distal end.

Figure 3:
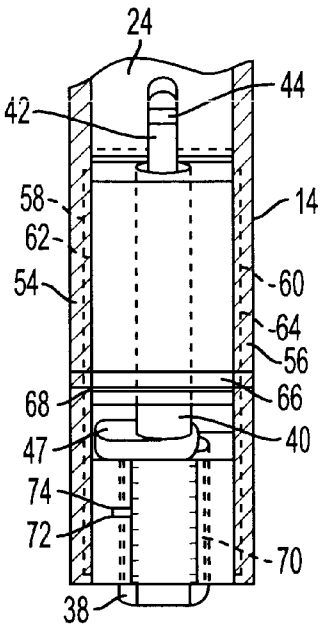
FIG. 3 is a longitudinal sectional view taken substantially along line 3—3 of FIG. 1.
Figure 7:
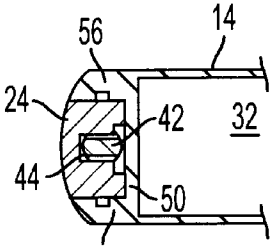
FIG. 7 is a sectional view taken substantially along line 7—7 of FIG. 6.
Figure 2:
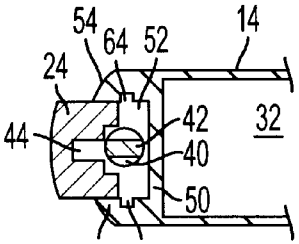
FIG. 2 is a cross-sectional view taken substantially along line 2—2 of FIG. 1.
Figure 4:
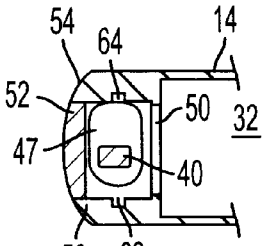
FIG. 4 is a sectional view taken substantially along line 4—4 of FIG. 1 showing a magazine lock in the open or armed position.
Figure 5:
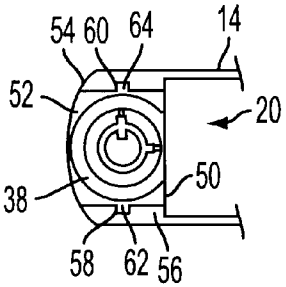
FIG. 5 is an end view taken substantially along line 5—5 of FIG. 1 showing the lock mechanism in an armed condition.

As can be best appreciated from FIGS. 1–3, a slot 44 is formed in a lower portion of the grip safety member 24 so as to receive the blade portion 42 when the lock mechanism 36 is in a "disarmed" position. As best appreciated from FIG. 6 and 7, the grip safety member 24 can be depressed and pivoted by the user's hand when gripping the pistol 10. As previously described, when the grip safety 24 is depressed, the blocking projection 28 is moved out of the way to allow the trigger mechanism 18, 30, 34 to be depressed as shown by arrows 46, 48. Referring now to FIGS. 8–12, it can be seen that when the lock cylinder 38 is rotated 90° to a "locked" or "disarmed" position, the blade portion 42 presents a face surface which has a width greater than that of the slot 44 in the grip safety 24. Depression of the grip safety 24 is thereby mechanically precluded. When the key (not shown) is removed from the lock cylinder 38, the locking mechanism 36 is positively locked in the "disarmed" position. In this position, the gun 10 cannot be fired or disassembled.

Referring now to FIGS. 1, 4, 8 and 11, therein is shown at 47 a cam or blade which is attached to and rotates with the rod 40 through an opening 49 in the rear wall 50 of the magazine passageway 32 The cam or blade 47 rotates, along with the blade 42, 90° into or out from the magazine passageway 32. When locked in the "disarmed" position (FIGS. 8 and 11), a mechanical block is provided to prevent insertion of a magazine into the magazine passageway 32. Additionally, the magazine (not shown) may be provided with a notch or slot for receiving the cam or blade member 47 so that the magazine may also be locked in place in the magazine passageway 32, thereby preventing its removal. This mechanism provides an added degree of safety to more completely disable the pistol 10 when the locking mechanism 36 is locked into the "disarmed" position.

In prior art pistols, such as the Model 1911, the space occupied by the lock mechanism 36 of the present invention would be otherwise unused. Prior art pistols that are similar in design to the illustrated embodiment have employed a filler block which creates the backstrap of the grip and supports the springs which bias both the grip safety and the trigger mechanism into their normal positions. In the illustrated embodiment which employs the present invention, the sear spring and grip safety spring have been omitted from the drawing for clarity.

Referring now to FIGS. 1–5, it can be seen that the locking mechanism 36 is constructed of a body 52 which is exposed along the backstrap of the grip 14 and which is held between first and second rearwardly-extending flange portions 54–56. The inner side of each side flange 54, 56 includes an elongated groove 58, 60 which runs substantially parallel to the rear wall 50 of the magazine passageway 32. The lock body 52, includes corresponding first and second laterally-extending lands or rails 62, 64 which allow the lock body 52 to be aligned and held in place in the grip 14 between the flanges 54, 56 by sliding the lock body 52 into position from the heel or butt end 22 of the grip 14. The lock body 52 is held in place by a laterally-extending pin 66 which passes through lateral opposite openings in the rearwardly-extending flanges 54, 56 and through a lateral groove 68 formed in the lock body 52. Removal of the locking mechanism 36 from the grip 14 is prevented, even if the locking pin 66 is driven out of place, if the locking mechanism 36 is in the "unarmed" or "disabled" position. This is because the cam or blade 46 is, at that time, extended through the opening 48 in the rear wall 50 of the magazine passageway 32 (see FIG. 8) which blocks the blocking mechanism 36 from being slid downwardly out of position.

In preferred form, the lock cylinder 38 is threadingly engaged in the lock body 52, as shown at 70, and rotation of the lock cylinder 38 is prevented relative to the lock body 52 by providing a flat surface on one side of the threaded portion which bears against an outer side of the wall 50. Using a "D-shaped" lock cylinder body to prevent relative rotation thereof is well-known. Additionally, a roll pen 72 or the like may be inserted into a transverse opening 74 formed across the threaded engagement 70. In this manner, rotation of the locking cylinder 38 relative to the lock body 52 or removal thereof is effectively prevented.

Figures 13, 14:
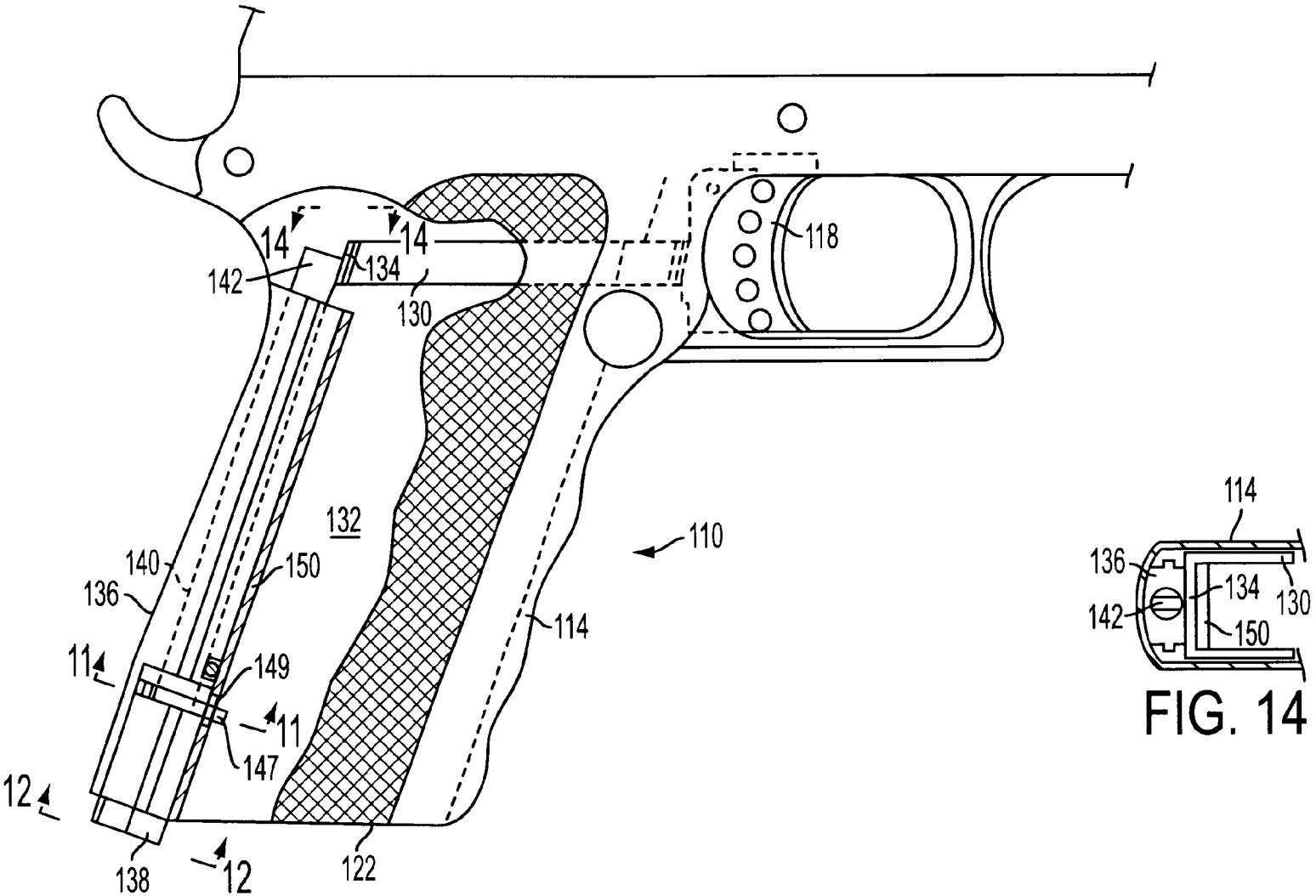
FIG. 13 is a partially cut-away, fragmentary view of the grip and trigger portion of a semi-automatic pistol showing a version of the present invention in a disarmed condition for a firearm which does not include a palm grip safety.
FIG. 14 is a sectional view taken substantially along line 14—14 of FIG. 13 showing the trigger mechanism blocked in a disarmed condition.

Referring now to FIGS. 13–16, therein is shown at 110 an alternate embodiment of the present invention for a semi-automatic pistol which does not include a grip safety. In this embodiment, the locking mechanism 136 provides a mechanical interference which directly blocks function of the trigger assembly. The locking assembly 136 is positioned at the backstrap of the grip 114 adjacent a rear wall 150 of the magazine passageway 132. A key lock cylinder 138 is exposed at the butt or heal end 122 of the grip 114. As in the previously-described embodiment, the lock cylinder 138 is operable to rotate a shaft 140 which includes a substantially flat blade portion 142 at its distal end. In this embodiment, the blade portion 142 directly interferes with the transverse rear section 134 of the trigger bail 130, thereby preventing the trigger 118 from being depressed, as shown in FIGS. 13 and 14.

Figure 15:
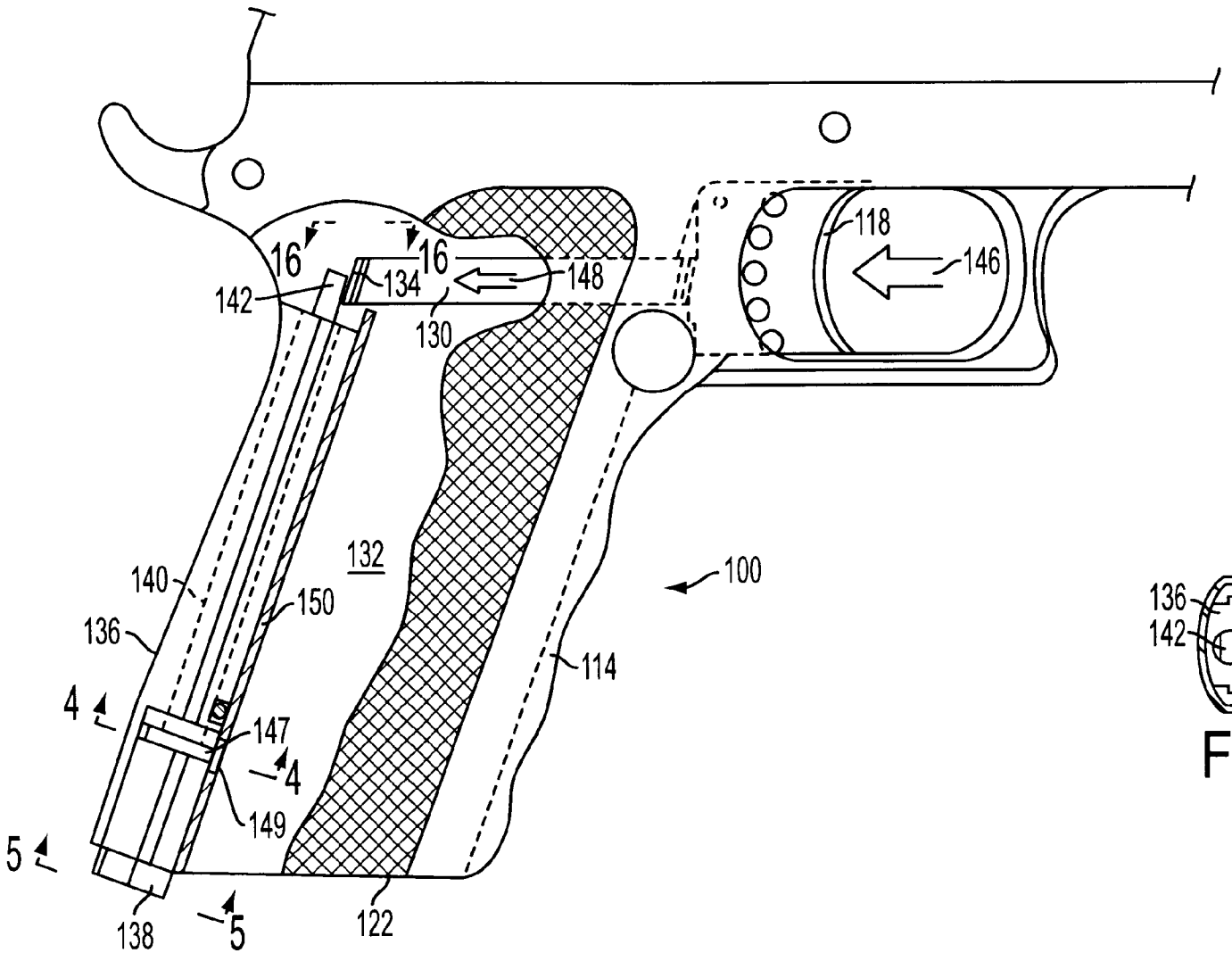
FIG. 15 is a partially cut-away fragmentary view similar to FIG. 13 showing the lock in an armed condition with the trigger depressed.
Figure 16:
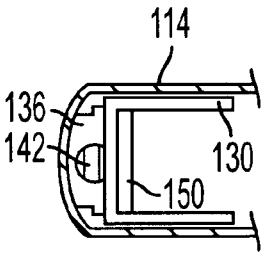
FIG. 16 is a sectional view taken substantially along line 16—16 of FIG. 15.

Referring now specifically to FIGS. 15 and 16, when the lock cylinder 138 is rotated to the "armed" position, the blade portion 142 of the rod 140 is rotated 90°. Accordingly, adequate space is provided so that the trigger 118 may be squeezed by the user, as shown by arrow 146, thereby moving the trigger bail 130, rearwardly as shown by arrow 148. This movement allows the trigger mechanism to actuate the firing mechanism (not shown) in any well known manner.

As described in the previous embodiment, the lock assembly 136 may also include a magazine passageway blocking member 147 which is rotatable to extend through an opening 149 in the rear wall 150 of the magazine passageway 132. The operation of this member is identical to that shown for the previous embodiment in FIGS. 4, 5, 11, and 12. Likewise, the assembly of the locking unit 136 into the grip 114 is also substantially identical to that described for the previous embodiment.

Either of the above-described embodiments may be used with or without the magazine passageway-blocking mechanism. Of course, utilizing this mechanism provides an added degree of safety to the firearm. Many other alterations or variations of the illustrated embodiments may also be employed by one skilled in the art. For example, the locking mechanism could provide a mechanical block or interruption directly to some part of the firing mechanism (i.e., hammer, firing pin, etc.) or could be incorporated into the grip of a revolver to function in a similar fashion. Also, it will be apparent to one skilled in the art that operation of the locking cylinder and/or blocking member may be axial rather than rotational or may be a combination of axial and rotational movement. In such an embodiment, the locking mechanism by which the user selects between "armed" and "disarmed" conditions could be operated electrically, such as by use of a solenoid. Linear movement of a locking selector either mechanically or electrically could be translated into rotational movement of the blocking member, or vice versa. Mechanisms of this type are well-known in the mechanical art. These alternative embodiments are less preferred, however, because additional springs and moving parts, as well as a battery power source, are required. Also, a solenoid-actuated locking selector may be used as part of so-called "smart gun" technology intended to allow the firearm to be operated only by a single user.

It will also be apparent to one skilled in the art that the above-described invention, unlike externally-applied trigger locks, is effective to completely disable the firearm whether loaded or unloaded and whether the magazine is inserted or removed. The locking mechanism stays with the fire arm at all times, and the present invention also employs a pick-resistant lock rather than a simple wrench or tool, as has been used in prior art devices.

Many other variations or embodiments of the present invention may be made by one skilled in the art without departing from the spirit and scope of the invention. Accordingly, the protection afforded by this patent is not to be limited by or to the above-described illustrated embodiments, but rather by the following claim or claims, interpreted according to the recognized doctrines of claim interpretation, including the doctrine of equivalents and reversal of parts.

What I claim is:

1. A locking, grip-enclosed safety device for a handgun, the device comprising:

a grip-enclosed mechanism having an externally-operable key operated selector and a mechanical trigger/firing mechanism interruption member, the selector being operable by a user to be placed in distinct armed and unarmed positions and the selector actuating the interruption member between respective distinct armed and unarmed positions, said mechanism comprising:

an axially-rotatable member with an engageable portion;

a movable part of the trigger/firing mechanism having a corresponding engageable portion;

one of said engageable portions comprising a socket with a non-round slot and the other portion comprising an insert with a corresponding non-round blade, the slot being oriented toward the blade without regard to whether the non-round slot and blade are in engageable registration relative to one another;

the axially-rotatable member being rotatable between distinct first and second positions, the first position corresponding to an armed position in which the slot and blade are in engageably aligned registration thereby allowing the slot to receive the blade and allowing relative movement between the axially-rotatable member and the moveable part of the trigger/firing mechanism for actuation of the trigger/firing mechanism, and the second position corresponding to an unarmed position in which the slot remains oriented toward the blade but the slot and blade are not in correspondingly aligned registration thereby preventing the blade from entering the slot and preventing relative movement between the axially-rotatable member and the moveable part of the trigger/firing mechanism for preventing actuation of the trigger/firing mechanism.

2. The device of claim 1, wherein the selector is lockable and actuated by a separable key.

3. The device of claim 1, wherein the grip has a butt end and the selector is exposed for operation at the butt end.

4. The device of claim 3, wherein the selector is lockable and actuated by a separable key.

5. A locking, grip-enclosed safety device for a firearm, the device comprising:

a grip-enclosed mechanism having an externally-operable locking selector and a mechanical trigger/firing mechanism interruption member, the locking selector being operable by a user to be locked in distinct armed and unarmed positions and the locking selector actuating the interruption member between respective distinct armed and unarmed positions, and;

further comprising means for mechanically blocking insertion of an ammunition magazine into the firearm, the means being actuated by the locking selector.

6. A locking, grip-enclosed safety device for a firearm, the device comprising:

a grip-enclosed mechanism having an externally-operable locking selector and a mechanical trigger/firing mechanism interruption member, the locking selector being operable by a user to be locked in distinct armed and unarmed positions and the locking selector actuating the interruption member between respective distinct armed and unarmed positions, and further comprising a member selectively actuated by the locking selector to block insertion and removal of an ammunition magazine for the firearm.

7. The device of claim 6, wherein the locking member comprises a rotatable member selectively actuated by the locking selector for movement into and out from an insertion pathway for an ammunition magazine for the firearm.

8. A locking, grip-enclosed safety device for a firearm, the device comprising;

a grip-enclosed mechanism having an externally-operable locking selector and a mechanical trigger/firing mechanism interruption member, the locking selector being operable by a user to be locked in distinct armed and unarmed positions and the locking selector actuating the interruption member between respective distinct armed and unarmed positions, and wherein the firearm further comprises a grip safety which must be displaced in order to fire the firearm and in which the interruption member is selectively movable between a position which mechanically blocks depression of the grip safety and a position which does not interfere with depression of the grip safety, these positions corresponding to the distinct unarmed and armed positions of the locking selector respectively.

9. The device of claim 8, wherein the interruption member is rotatably actuated by the locking selector, and comprising a blade portion and a slot, one of which is part of the interruption member and the other of which is part of the grip safety, wherein the blade portion and slot are sized and shaped such that when in a first position, the blade fits within the slot allowing operational movement of the grip safety and a second position in which the blade portion will not fit into the slot, thereby blocking operational movement of the grip safety.

10. The device of claim 9, further comprising a member actuated by the locking selector and rotatable with the interruption member, selectively extendable into a position blocking insertion of an ammunition magazine into the firearm.

11. A locking, grip-enclosed safety device for a firearm, the device comprising:

a grip-enclosed mechanism having an externally-operable locking selector operably connected to an axially-rotatable elongated rod member, the locking selector being operable by a user to be locked in distinct armed and unarmed positions and actuating the rod member between respective distinct armed and unarmed positions;

the rod member having an end blade portion, the end blade portion having a width and a thickness wherein its width is significantly greater than its thickness;

the rod member axially rotatable approximately 90 degrees about an axis of rotation such that the relative transverse dimension of the rod's end blade portion is selectively changed by such rotation, thereby selectively blocking or allowing movement of a trigger/firing mechanism member in a direction substantially radial to the rod's axis of rotation.

* * * * *